US005328153A

United States Patent [19]

Levinson

[11] Patent Number: 5,328,153

[45] Date of Patent: Jul. 12, 1994

[54] PNEUMATIC APPARATUS FOR LIFTING AND LOWERING

[75] Inventor: Valery Levinson, Karmiel, Israel

[73] Assignee: The State of Israel, Ministry of Defence, Rafael Armament Development Authority, Tel-Aviv, Israel

[21] Appl. No.: 916,946

[22] Filed: Jul. 20, 1992

[30] Foreign Application Priority Data

Jul. 26, 1991 [IL] Israel ..... 98975

[51] Int. Cl.[5] ..... B66F 7/20

[52] U.S. Cl. ..... 254/2 R

[58] Field of Search ..... 91/28, 29, 31, 32, 33; 254/2 R, 2 B, 4 R, 4 B, 89 H, 93 R, 1

[56] References Cited

U.S. PATENT DOCUMENTS

| | | | |
|---|---|---|---|
| 2,963,865 | 12/1980 | Thomas | 91/28 |
| 4,007,826 | 2/1977 | Brown et al. | 91/29 |
| 4,230,304 | 10/1980 | Tol | 254/89 H |
| 4,337,845 | 7/1982 | Zelli et al. | 254/2 R |
| 4,759,256 | 7/1988 | Kovit et al. | 91/33 |
| 4,955,195 | 9/1990 | Jones et al. | 91/33 |

*Primary Examiner*—Robert C. Watson

*Attorney, Agent, or Firm*—Fitch, Even, Tabin & Flannery

[57] ABSTRACT

A mobile pneumatic apparatus for combined pneumatic and manual lifting and lowering of heavy objects. A vertically reciprocable carriage is mounted on a trolley and is linked by a hauling device to a vertically reciprocable pneumatic piston associated with gas flow controls and a weight sensor. The piston may optionally be coupled with hydraulic braking means.

5 Claims, 2 Drawing Sheets

PNEUMATIC APPARATUS FOR LIFTING AND LOWERING

FIELD OF THE INVENTION

The present invention concerns a pneumatic apparatus for lifting and lowering and serving as an auxiliary in the performance of a variety of manual manipulations of heavy objects such as, for example, loading, positioning, unloading and the like. One specific use of the invention concerns the loading and unloading of airborne missiles onto and from launchers located underneath the wings and fuselage of an aircraft. Another example of an application of an apparatus according to the invention is the hoisting of structural elements for accurate manual positioning; and there are many others.

BACKGROUND OF THE INVENTION

In situations in which it is required to lift heavy objects and to position or lock them accurately one is often caught at an impasse resulting from the incompatibility of the desire for accurate manual handling with the need for mechanical hoisting and lowering, and this very often leads to unreliable improvisation. A case in point is the loading of airborne missiles into launchers located underneath the wings and fuselage of an aircraft. Such missiles are quite heavy, yet mechanically hoisting a missile all the way up to the launcher would defeat the purpose of accurate positioning while manually lifting a missile all the way up and then positioning it is difficult to perform.

It is accordingly the object of the present invention to provide an apparatus for use as an auxiliary in the manual manipulation of a heavy object designed to provide a lifting force so determined that a heavy object can be lifted and lowered in a reliable and secure manner with the exertion of a relatively small manual force, thereby to combine the advantages of mechanical lifting and accurate manual positioning.

SUMMARY OF THE INVENTION

In accordance with the present invention there is provided a mobile pneumatic apparatus serving as an auxiliary for manually lifting and lowering a heavy object comprising:

i) a trolley having mounted thereon a vertically reciprocable carriage for holding said heavy object;

ii) a vertically reciprocable pneumatic piston linked to a source of compressed gas and having an upward emerging piston rod carrying an idler pulley;

iii) a valve means assembly for controlling the gas flow in and out of said pneumatic piston and including a manually operable valve member for controlling backflow of pressurized gas from said pneumatic piston;

iv) sensor means cooperating with said carriage for actuation of said valve means assembly for the purpose of lifting such that the lifting force acting on said pneumatic piston is always smaller by a predetermined amount from the total weight of the carriage; and v) hauling means linking said carriage via said pulley to said sensor means.

The term "total weight of the carriage" refers to the weight of either the unloaded or the loaded carriage, as the case may be.

Due to the fact that the hauling means run over the roller pulley on top of the piston rod the total weight of the carriage is counter-acted by the lifting force provided by the pneumatic piston. Since that lifting force is always somewhat smaller than the total weight of the carriage, there always remains a balance of force necessary for lifting and positioning the object, which balance force is provided manually. Assuming, for example, the total weight of the unloaded carriage to be 10 kg, then the sensor means will so actuate the valve means assembly that the lifting force provided by the pneumatic piston will be smaller than 10 kg, say about 7 kg so that the balance force which the operator has to exert in order to lift the unloaded carriage is about 3 kg. If the carriage is loaded and the total weight thereof is say 50 kg, the sensor will so control the valve means assembly that the lifting force of the pneumatic piston is slightly less than the total weight of the loaded carriage, say 47 kg. Again, the balance force that has to be exerted by the operator will be about 3 kg.

Preferably the valve means assembly is adjustable whereby it can be set in accordance with the expected weight of the object to be lifted to ensure that for each load the lifting force of the piston is always close to yet less than the total weight of the carriage. In this way the apparatus according to the invention is rendered versatile and can be used for lifting objects of different weights.

Due to the provision of the backflow control valve means the carriage is arrested at any height whenever the exertion of manual lifting force is interrupted with practically no sliding back.

At the beginning of operation the valve means assembly is switched on manually whereupon the sensor means actuate the valve means assembly to provide a lifting force commensurate with and slightly smaller than the self-weight of the empty carriage. When now a heavy object is loaded onto the carriage, the total weight thereof is increased and this increased weight is sensed by the sensor means which actuate the valve means so as to provide a lifting force commensurate with and slightly smaller than the total weight of the loaded carriage. From this state the operator can lift the loaded carriage by exerting the necessary small balance force and in this way he can easily position and lock the object as may be required.

For lowering the carriage, whether loaded or unloaded, the backflow control valve means is manually shifted into a gas exhaustion position whereby the carriage is lowered automatically with the gas being expelled from the piston cylinder.

Preferably, the piston rod of the pneumatic piston is coupled to hydraulic braking means, e.g. a speed control check cylinder filled with a hydraulic fluid, whereby the pneumatic piston is damped during transitions from motion to standstill and vice versa.

The gas used for the pneumatic system is preferably air.

DESCRIPTION OF THE DRAWINGS

For better understanding, a specific embodiment of the invention will now be described, by way of example only, with reference to the annexed drawings in which.

DESCRIPTION OF A SPECIFIC EMBODIMENT

Figure 1:
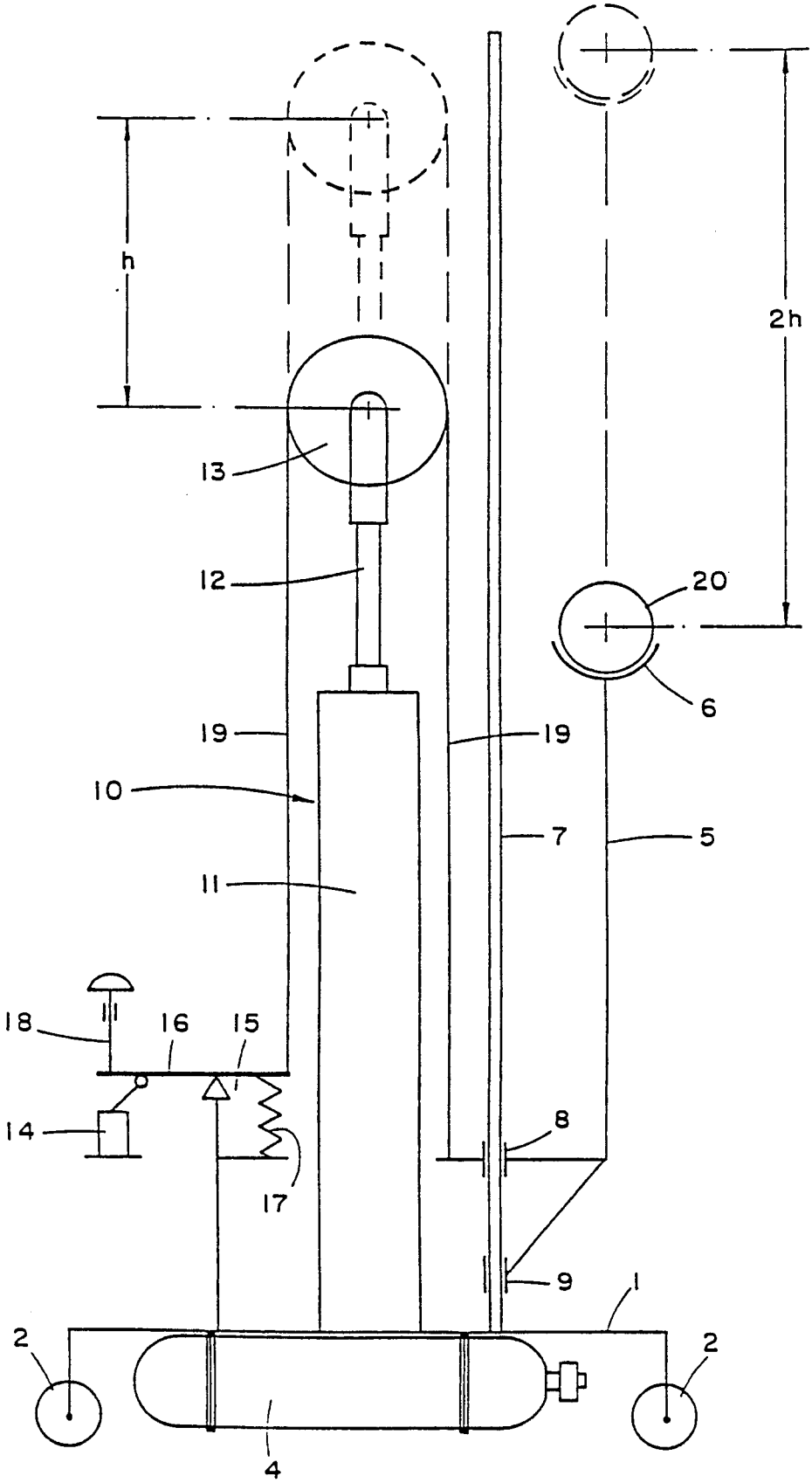
FIG. 1 is a diagrammatic illustration of an apparatus according to the invention.

The apparatus according to the invention shown in FIG. 1 comprises a trolley 1 fitted with four wheels 2 (only two of which are shown) and carrying underneath a cylinder 4 holding compressed air.

A carriage 5 fitted with a trough-shaped holder member 6 is slidingly mounted on a pair of rails 7 (only one of which is seen in FIG. 1) by means of glider members 8 and 9 and in this way carriage 5 is vertically reciprocable.

Carriage 1 further carries a pneumatic piston assembly 10 connected to the gas cylinder 3 and comprising a cylinder 11 holding a piston 33 (FIG. 2) integral with a piston rod 12 which emerges out of the upper end of cylinder 11 and carries at its end portion an idler pulley 13.

A valve means assembly 14 symbolized in FIG. 1 by means of a single valve member, is designed to control the operation of the pneumatic piston assembly 10. Valve means assembly 14 is associated with sensor means 15 comprising a lever 16, a spring 17 and a manual actuator 18.

A chain 19 serving as hauling means links the bottom portion of carriage 5 with lever 16 of the sensor assembly 15 via the idler pulley 13 and in this way the total weight of the carriage 5 bears on the piston.

In FIG. 1, carriage 5 is shown in its lowermost position.

In operation, a load 20 such as an airborne missile which has to be loaded onto and locked in a launcher, is placed on the holder 6. If desired, locking means may be provided on holder 6 for securely holding the missile 20 during lifting. There results a pull on chain 19 whereby lever 16 of the actuator assembly 15 is turned anti-clockwise against the biasing action of spring 17. In consequence, the valve assembly 14 is actuated and the piston assembly 10 provides a lifting force which is slightly smaller than the total weight of carriage 5 and object 20. From this state the carriage can be lifted manually by an operator by a distance 2h to the uppermost position shown in dashed lines, by the exertion of a relatively small manual force, and the piston 33 and with it piston rod 12 and pulley 13 follow the upward movement of carriage 5 continuously at half the pace of the carriage so that when the carriage is raised by 2h, piston rod 12 with idler wheel 13 are raised by h.

The valve assembly 14 comprises, inter alia, a backflow control valve member which controls the expulsion of pressurized air from the piston assembly 10. During lifting the exhaust valve is shut and this, together with the non-return valve means prevents any air backflow. Accordingly, whenever the operator discontinues the exertion of his own manual force, be it because carriage 5 has reached its uppermost position or be it because the lifting operation has temporarily to be interrupted, the pressurized air within the hydraulic piston assembly 10 cannot escape, and the pressurized air cushion that forms within the piston assembly prevents the piston from being lowered whereby the carriage is retained essentially in the position it was when manual manipulation was interrupted.

When carriage 5 does not carry any load the self-weight of the carriage is not sufficient for the actuation of the valve assembly 14 by the sensor assembly 15 and accordingly the piston assembly 10 is in a state of rest in which the pressure inside the piston is sufficient only for the creation of a lifting force that is slightly smaller than the self-weight of the carriage. When it is desired to use the apparatus for lowering an object that had been lifted before, e.g. withdrawing a missile from a launcher in an aircraft, the operator lifts the carriage 5 by exerting a small force corresponding to the difference between the lifting force of piston assembly 10 and the self-weight of carriage 5. When the carriage 5 is loaded at the desired level, actuator 18 is operated manually whereby piston assembly 10 is pressurized to provide a lifting force commensurate with and somewhat smaller than the total weight of the loaded carriage. By manually switching open the backflow control valve means, pressurized air can be exhausted from the piston assembly 10 and consequently carriage 5 sinks spontaneously by the action of its own weight.

Figure 2:
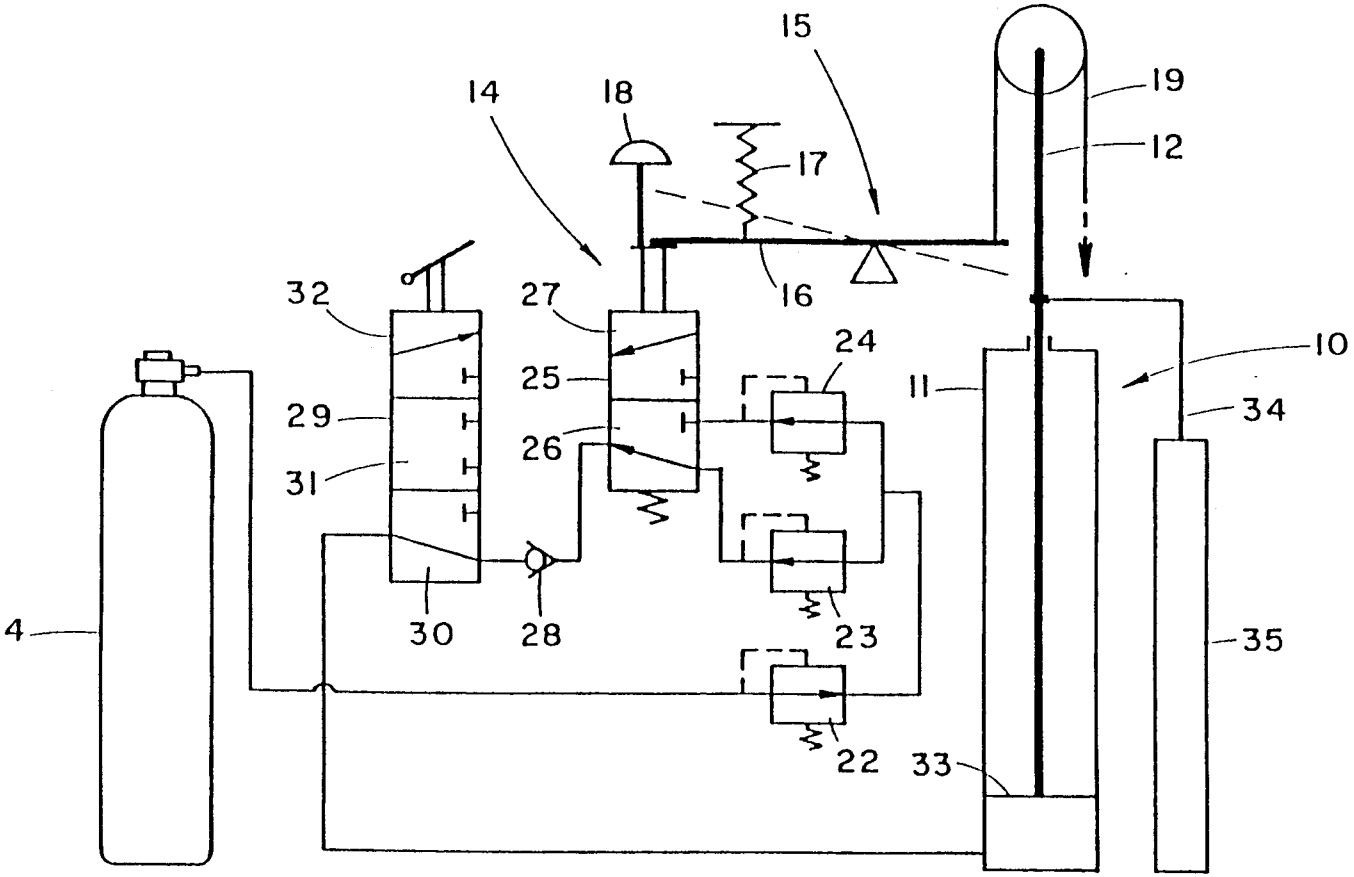
FIG. 2 is a pneumatic flow diagram.

The pneumatic flow diagram of the apparatus according to FIG. 1 is shown in FIG. 2. For the sake of clarity of illustration the diagrammatic representation of the sensor means is here somewhat different than in FIG. 1.

As shown, the valve means assembly 14 comprises a first regulator valve 22 for reducing the pressure of the gas arriving from cylinder 4 where the pressure is from 200 to 300 atmospheres, down to the operational range. There are further provided second and third regulator valves 23 and 24 of which the former is designed to deliver relatively low pressure commensurate with the total weight of the unloaded carriage while the latter is designed to deliver a relatively high pressure commensurate with the self-weight of the loaded carriage.

Lever 16 of sensor means 15 is biased into the slanted position shown by way of dashed lines and the lever is associated with a two-position three-way valve 25 having chambers 26 and 27.

There is further provided a three-position three-way valve 29 with chambers 30, 31 and 32; and a non-return valve 28.

In the rest state valve 25 is at its uppermost position shown in FIG. 2 in which the low pressure regulator valve 23 communicates via chamber 26 of valve 25 with chamber 30 of valve 29. In this state low pressure is delivered into piston assembly 10 commensurate with the self-weight of the unloaded carriage 5 (FIG. 1). When now, a weight 20 is put on holder members 6 of carriage 5 (FIG. 1) the pull exerted on chain 19 by the total weight of the loaded carriage causes lever 16 to turn anti-clockwise against the biasing action of the spring into the position shown by way of a bold line. By so turning, lever 16 depresses the valve 25 whereby the second regulator valve 24 now communicates with chamber 30 of valve 29 and higher pressure is delivered into the piston to create a lifting force commensurate with the total weight of the loaded carriage.

When it is desired to interrupt the lifting operation at any level, valve 29 is manually shifted into a second position in which the piston assembly 10 communicates with the sealed chamber 31 of valve 29 and in this position there can be no gas backflow from the piston assembly 10 and consequently carriage 5 is retained essentially in the position in which it was left off.

Once the carriage is unloaded and the pull on chain 19 accordingly reduced to the self-weight of the carriage only, lever 16 of actuator assembly 15 turns spontaneously clockwise, back into the slanted position shown by way of dashed lines, and as a result the spring loaded valve 25 rises spontaneously back to the start position shown in FIG. 2.

From the start position in which the second regulator valve supplies pressure commensurate with the self-weight of the unloaded carriage, the latter can be lifted manually up to the uppermost position for the purpose of unloading and lowering a heavy object, including a missile from a launcher of an aircraft. Once the carriage has reached the upper position, valve 25 is manually actuated through actuator 18 to bring it into the position in which high pressure regulator valve 24 is connected with chamber 30 of valve 29 and the load is placed on the load holder 6 of carriage 5. For lowering the load valve 29 which also functions as backflow control valve, is actuated manually in such a way that chamber 32 thereof communicates with piston assembly 10 and as a result the air from the piston assembly is exhausted and the loaded carriage sinks spontaneously.

The piston rod 12 is coupled with the piston rod 34 of a hydraulic braking device 35 whereby transitions of the piston rod 12 from a state of rest to a state of motion and vice versa is damped and proceeds smoothly.

I claim:

1. A mobile pneumatic apparatus serving as an auxiliary for manually lifting and lowering heavy objects comprising:

i) a trolley having mounted thereon a vertically reciprocable carriage for holding said heavy object;

ii) a vertically reciprocable pneumatic piston linked to a source of pressurized gas having an upward emerging piston rod carrying an idler pulley;

iii) a valve means assembly for controlling the gas flow in and out of said pneumatic piston and including a manually operable valve member for controlling backflow of pressurized gas from said pneumatic piston;

iv) sensor means responsive to the total weight of the carriage and cooperating with said carriage for actuation of said valve means assembly for the purpose of lifting such that the lifting force of the said pneumatic piston is always smaller by a predetermined amount from the total weight of the carriage; and v) hauling means linking said carriage via said pulley to said sensor means.

2. An apparatus according to claim 1, wherein the valve means assembly is adjustable whereby the apparatus is set to the expected weight of the object to be lifted.

3. An apparatus according to claim 1, wherein the rod of said vertically reciprocable pneumatic piston is coupled with hydraulic braking means whereby transition from a state of rest to a state of motion and vice versa is damped.

4. An apparatus according to claim 2, wherein the rod of said vertically reciprocable pneumatic piston is coupled with hydraulic braking means whereby transition from a state of rest to a state of motion and vice versa is damped.

5. A mobile apparatus to facilitate manual lifting and lowering of an object, the apparatus comprising:

a trolley;

a vertically reciprocable carriage mounted on said trolley for holding said object thereon;

a pneumatic piston mounted vertically on said trolley and connected to said carriage for vertical reciprocation of said carriage together with said piston; and sensor means operatively interconnected with said pneumatic piston and being responsive to the load of the carriage having said object thereon, said sensor means being operatively interconnected with said pneumatic piston to provide a lifting force to said pneumatic piston which is smaller, by a predetermined amount, than the load of the carriage having said object thereon, to allow raising of said carriage having said object thereon to a selective height upon imposition of upward manual force to the object in excess of said predetermined amount.

* * * * *